United States Patent [19]

Nigrelli

[11] 4,391,078

[45] Jul. 5, 1983

[54] LOADING BLADES FOR PACKAGING APPARATUS

[75] Inventor: Biagio J. Nigrelli, Kiel, Wis.

[73] Assignee: Nigrelli Corporation, Kiel, Wis.

[21] Appl. No.: 325,066

[22] Filed: Nov. 25, 1981

Related U.S. Application Data

[62] Division of Ser. No. 112,589, Jan. 16, 1980, Pat. No. 4,332,121.

[51] Int. Cl.[3] ..... B65B 5/04

[52] U.S. Cl. ..... 53/251

[58] Field of Search ..... 53/251, 252, 248, 249, 53/250, 255, 260, 261, 262

[56] References Cited

U.S. PATENT DOCUMENTS

| | | | |
|---|---|---|---|
| 3,034,270 | 5/1962 | Nigrelli et al. | 53/251 X |
| 3,053,025 | 9/1962 | Nigrelli et al. | 53/251 X |
| 3,332,200 | 7/1967 | Englander | 53/251 X |
| 3,481,108 | 12/1969 | Englander et al. | 53/251 X |
| 3,805,476 | 4/1974 | Kawamura et al. | 53/251 X |

FOREIGN PATENT DOCUMENTS

| | | | |
|---|---|---|---|
| 222777 | 10/1958 | Australia | 53/251 |

*Primary Examiner*—Horace M. Culver

*Attorney, Agent, or Firm*—Henry C. Fuller

[57] ABSTRACT

A case loader for placing articles such as beverage packs in cases or cartons includes a supply conveyor for articles and a carton conveyor which merges into the article conveying path and pairs of spaced guide plates or loading plates supported on overhead endless chains arranged along the sides of the conveying path to grip and center the articles on the supply conveyor and to "shoe horn" the articles into the cartons. A case displacement lever pivots in the gap between spaced runs of the case conveyor to raise the leading edge of the case or carton upwardly to lessen the drop distance of the article into the case to minimize damage.

2 Claims, 10 Drawing Figures

LOADING BLADES FOR PACKAGING APPARATUS

CROSS REFERENCE TO RELATED APPLICATION

This application is a division of my co-pending U.S. patent application Ser. No. 112,589, filed Jan. 16, 1980 now U.S. Pat. No. 4,332,121.

BACKGROUND OF THE INVENTION

The invention relates to a case loader for loading shipping cases, either with closure flaps or open trays with one or more articles being loaded in the container. More particularly, the invention relates to a case loader provided with article loading guides to guide or "shoe horn" articles into a case or tray. My prior U.S. Pat. No. Re. 25,852 discloses article guiding apparatus intended to accomplish this objective. The disclosure in this patent shows guide plates 149 which are connected to arms 150 which extend back to a pivot 151. Alongside the arms are attached cam plates 163 with an upwardly inclined edge. The conveyor chain 18 which pushes the product forward with the use of cross rods 19 also actuates the guide plates as the cross rods 19 engage the cam plates 163 and causes the guide plates 149 to dip into the waiting case. The present invention greatly simplifies the mechanism and procedure to accomplish the guiding and loading of articles into cartons.

SUMMARY OF THE INVENTION

The present invention provides article guide plates for centering articles on a skid plate and "shoe horning" articles into cases or cartons as the articles are swept off the skid plate. The guide plates are arranged in pairs with the plates in each pair located on opposite sides of the article conveying path and carried on spaced endless chains. The guide plates are pivotally mounted intermediate their length, with torsion springs arranged around the pivots to bias the guide plates inwardly into contact with the articles. As the articles to be loaded approach the loading station on a supply conveyor, the plates move into position on opposite sides of the articles and embrace the articles. Cam rails extending longitudinally alongside the conveying path engage the upper end of the guide plate arms above their pivots and pivot the plates and open the gap between the opposed plates to release the articles from their grip as they are pushed off a skid plate and deposited in the carton. The cam rails also open the gap between the plates prior to registry with the cartons.

The articles are moved over the skid plates by pusher bars connected to the same chains which carry the loading plates, which assures proper alignment of the plates with the articles.

The present invention provides apparatus which is relatively simple to accomplish the loading sequence with the use of loading plates which are always in the appropriate position to perform their function.

Further objects, advantages and features of the invention will become apparent from the disclosure.

DESCRIPTION OF THE DRAWINGS

FIG. 7 is a diagrammatic plan view of the cam rails for the guide plates.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figures 1, 2:
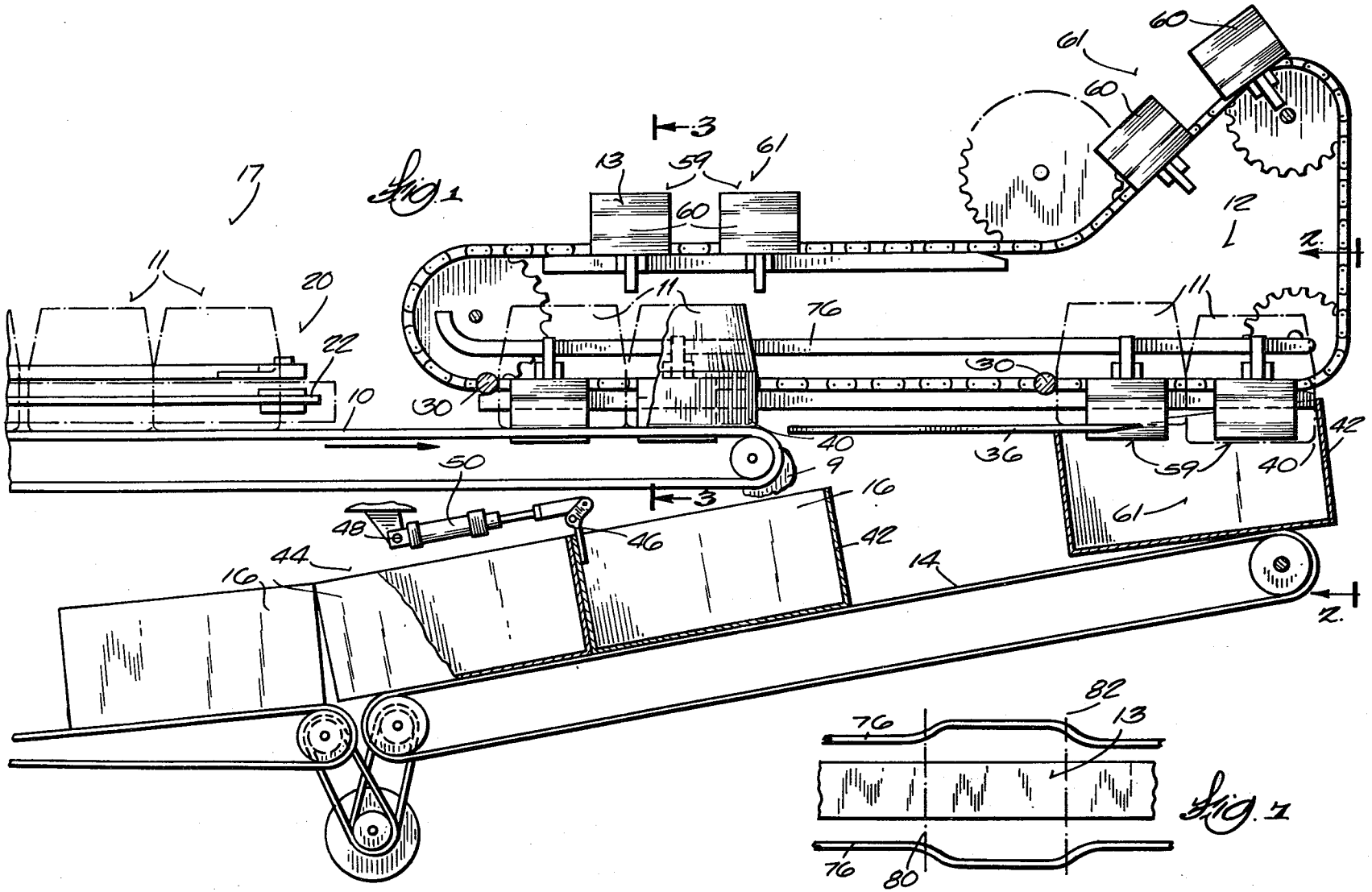
FIG. 1 is a schematic side elevational view of case loading apparatus in accordance with the invention.
FIG. 2 is a view along line 2—2 of FIG. 1.
Figure 2:
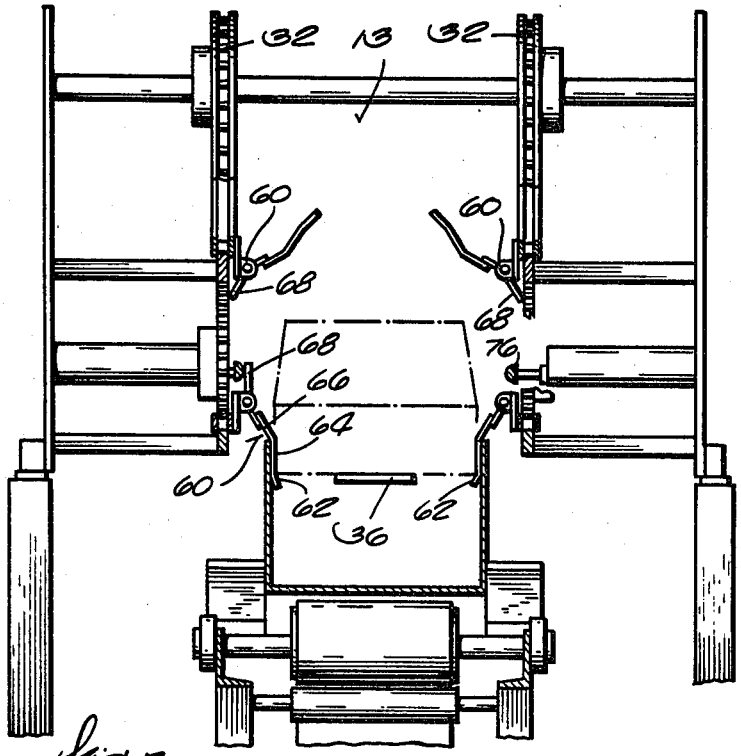

In the drawings, FIG. 1 shows a feeding or supply conveyor 10 supported on a frame 9 for moving articles to be deposited in cartons or cases 16. A conveyor 14 brings cases or cartons 16 to the case loading station 12 where they receive the deposited articles 11. The cartons 16 can be open trays or provided with downturned flaps.

In the disclosed construction, two articles 11, such as multi-packs of a beverage are released from a staging area 17 by a release mechanism 20 in timed sequence, as hereinafter described in more detail, so that a complement of two articles 11 will be deposited in a single carton 16. Although in the drawings two articles are shown deposited in a carton, other numbers of articles can be packed using the loading plates and associated apparatus of the invention.

Figure 5:
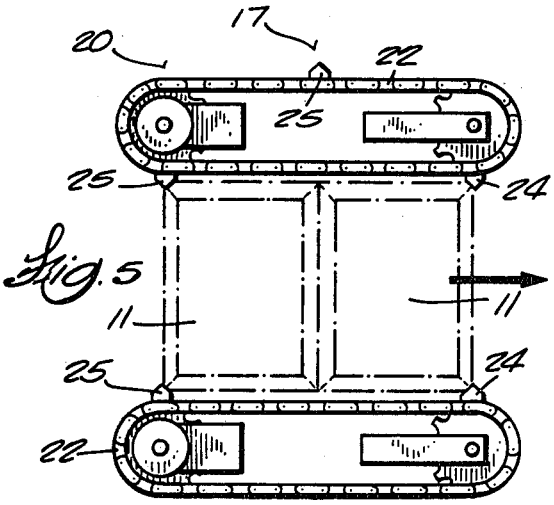
FIG. 5 is a top view of the supply conveyor and article release mechanism.

The article separator and release mechanism 20 (FIG. 5) at the staging area comprises spaced endless chains 22 which travel in a horizontal plane and which are provided with inwardly and laterally extending lugs 24, 25 which, as shown, confine an article or complement of articles on the supply conveyor 10. Upon energization and movement of the leading lugs 24, both articles 11 in the groups are released and are moved by the conveyor 10. The lugs 25 move to the position formerly occupied by lugs 24 and hold back the next complement of articles to be loaded.

Figure 8:
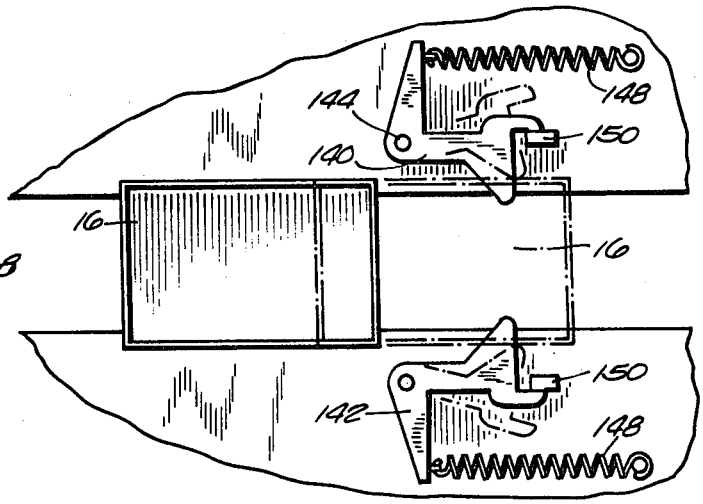
FIG. 8 is a plan view of case holding fingers.

The released complement of articles 11 are then picked up by cross bars or pusher bars 30 which span the conveying path 13 (FIG. 1) and are connected to a pair of spaced endless chains 32 which are located above and along opposite sides of the conveying path 13 (FIG. 2). The pusher bars 30 push the articles 11 from the conveyor 10 onto a skid plate 36 and ultimately push the articles 11 from the skid plate 36 into the carton 16. The cartons 16 are detained at the right end of conveyor 14, as viewed in FIG. 1, by fingers 140, 142 illustrated in FIG. 8. The leading corner or edge 40 of the leading article in the group of articles engages the forward wall 42 of the carton. The pusher bars 30 push the cartons and articles through the fingers 140, 142.

The cases 16 are released by an escapement mechanism 44 which, as illustrated, includes a lever 46 which is pivotally connected at 48 to the frame and a power cylinder 50 which is connected to the lever. Actuation of the cylinder 50 in timed sequence with the article release mechanism 20 (by conventional means not disclosed herein) pivots the lever from within the case 16 to allow the leading case to escape and be separated from the row of cartons where it is retained by the fingers 140, 142.

In accordance with the invention, means are provided for centering the articles on the skid plate and guiding the articles into the cartons during deposition. In the disclosed construction, the means comprises pairs 59 of guide or loading plates 60 (FIGS. 1, 2, 4 and 6), with the guide plates 60 connected to the spaced chains 32 and with the plates arranged in allochiral or right and left hand relationship. The pairs 59 are arranged and spaced on the chains 32 to handle the article load being deposited. As disclosed, there are groups 61 of two closely spaced pairs 59 of plates 60 arranged to facilitate loading of a complement of two articles.

Figure 4:
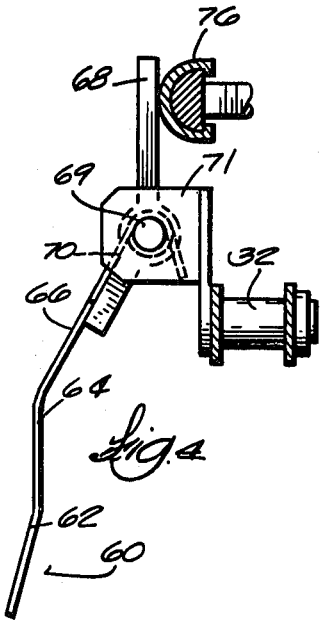
FIG. 4 is an enlarged side elevational view of one of the loading plates shown in FIGS. 2 and 3.
Figure 6:
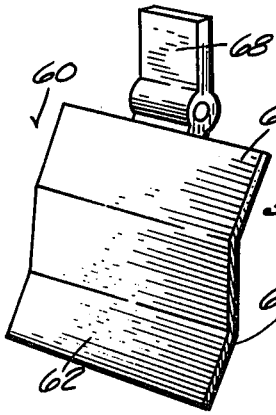
FIG. 6 is an enlarged perspective view of a loading plate.

As illustrated in FIGS. 4 and 6, the plates 60 include an inwardly flared portion 62 and two angularly related portions 64 and 66. The plates 60 are connected to cam engaging arms 68 which are pivoted by pivot pins 69 to a bracket 71 which is connected to the chain 32. The guide plates are desirably made of springy metal to facilitate their release from the carton during the loading sequence. Torsion springs 70 arranged around the pivot pins 69 bias the ends 62 of the plates inwardly toward the conveying path.

Figure 3:
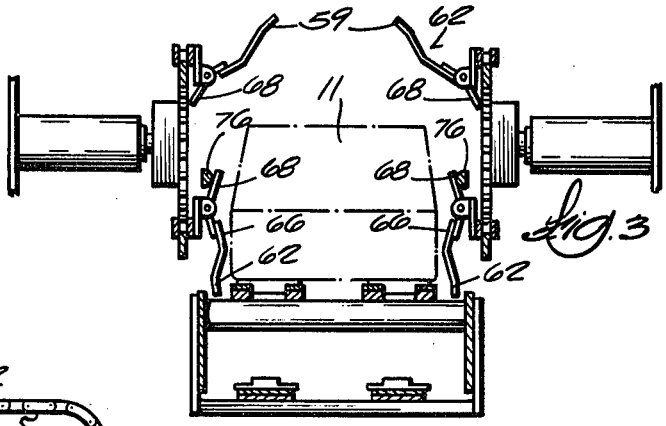
FIG. 3 is a view along line 3—3 of FIG. 1.

In addition to the springs 70, the position of the loading plates 60 is controlled by cam rails 76 located on opposite sides of the conveying path 13 (FIGS. 2, 3 and 7). The rails 76 have a low friction covering such as TEFLON and are positioned to engage the arms 68 and displace the plates about pivot pins where appropriate, to space the ends 62 of the plates to receive therebetween the articles 11, as illustrated in FIGS. 2 and 3. The rails 76 allow the plates to operate under influence of the torsion springs 70 to move to an advanced position to embrace or grip the articles, as shown in FIG. 2, to center and guide the articles into the carton.

In operation, and referring to FIG. 7, the cam rails 76 to the left of line 80 in FIG. 7 are in the position shown in FIG. 3 to displace the loading plates outwardly to receive the articles 11. As the articles move between the pairs of plates, the cam rails 76 diverge outwardly to the right of line 80 in FIG. 7 and allow the springs 70 to urge the loading plates 60 against the articles 11 to center the articles. Once the loading plates have guided the lower edges of the articles into the carton, as illustrated in FIG. 2, the loading plates are no longer needed. Cam rails 76 converge inwardly at line 82 (FIG. 7) and cause the plates 60 to release their grip on the articles and pivot to a retracted position, allowing the articles to fall to the bottom of the cartons 16.

Figure 9:
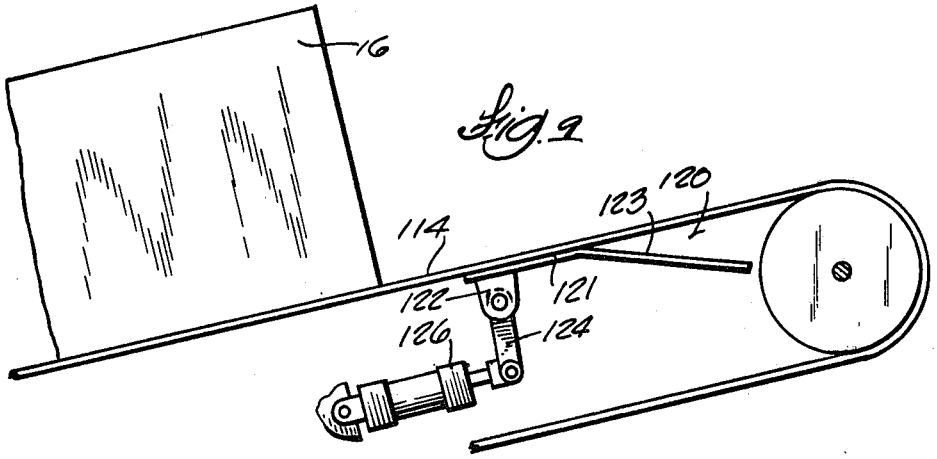
FIG. 9 is a diagrammatic side elevation view of a modified embodiment with a case tilting plate.
Figure 10:
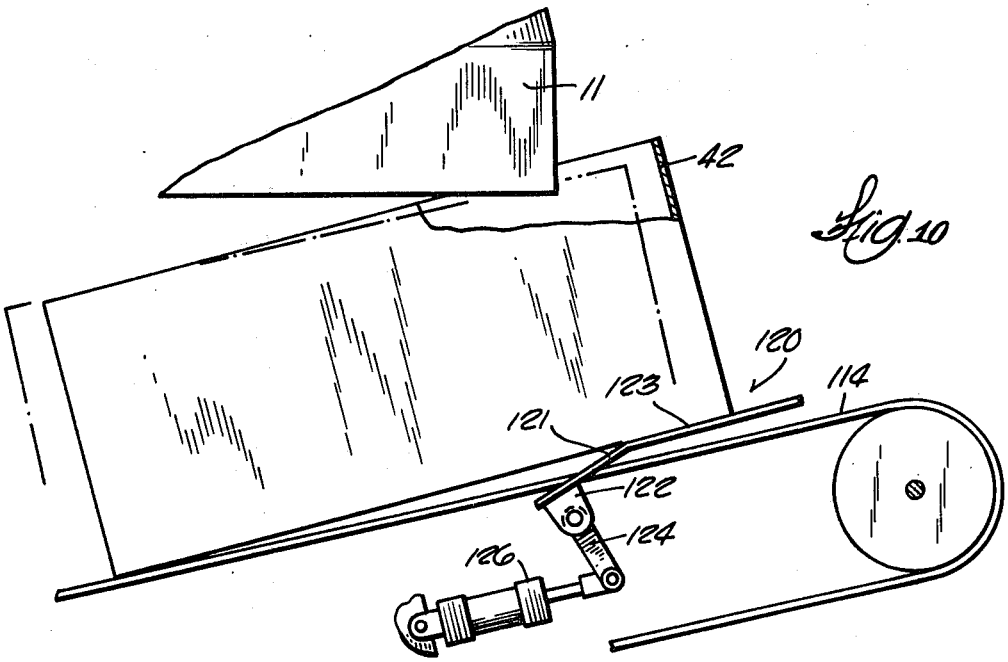
FIG. 10 is a view similar to FIG. 9 with the plate in an advanced carton displacing position.

FIGS. 9 and 10 show a modified embodiment of the lower inclined conveyor which carries the cases or cartons to receive the contents at the loading station. In FIG. 9 the conveyor includes two spaced belts 114 which are separated by a gap. A case or carton displacement lever 120 formed by two angularly related portions 121 and 123 is pivotally supported on the frame by pivot 122 and connected to a crank arm 124 which is moved by a power cylinder 126. The plate is operated in sequence by sensors, etc. (not disclosed) to lift the leading edge of the carton 16 prior to deposition of the articles. Raising the cartons lessens the distance the article drops into the carton to thus reduce breakage or damage to the article or its packaging. It also insures that the leading edge 42 of the carton 16 will be intercepted by the moving article 11. The leading case 16 is desirably held in the FIG. 10 position by fingers 140 and 142 which are located on opposite sides of the conveying path and which are pivotally connected to the frame by pivots 144 and spring biased into the path of travel of the cartons 16 by springs 148. Stops 150 limit the inward movement of the fingers. When an article 11 intercepts the case 16, the pressure from the pusher bars 30 is sufficient to overcome the grasp of the fingers to push the loaded cases between the fingers.

Although in the disclosed construction cam rails are employed to displace the loading plates outwardly to release the cartons, springy loading plates can be used without any displacement means where the articles loaded are sufficiently heavy to push through the plates as the articles leave the skid plate 36. The plates 60, as shown, can be used with or without the cam rails, depending on the weight of the articles.

What is claimed is:

1. In a case loader having an article conveyor for moving articles along support means having an upper surface defining a first plane, a case conveyor located beneath the article conveyor and in which the case conveyor path merges upwardly into the conveying path of the article conveyor from below, the improvement wherein said case conveyor includes two spaced parallel conveyor runs separated by a gap and a case displacement lever, and means for supporting and operating said lever for pivotal movement between an advanced position extending in said gap between said conveyor runs to engage the under surface of a carton and raise a portion of the carton above said first plane and above the bottom of an article carried on said article conveyor to intercept the leading end of an article carried on said conveyor to insure engagement of the leading edge of said carton with the article being loaded and to minimize the distance the articles must fall into the case and said means for supporting and operating said lever affording movement of said lever to retracted position below said first plane to afford movement of the filled case from said case conveyor.

2. The improvement of claim 1 wherein said displacement lever has first and second angularly related sections which receive the leading end of a case.

* * * * *